US005158475A

United States Patent [19]

Tyler

[11] Patent Number: 5,158,475

[45] Date of Patent: Oct. 27, 1992

[54] SOLENOID

[75] Inventor: Stephen L. Tyler, Diamond Bar, Calif.

[73] Assignee: The Toro Company, Minneapolis, Minn.

[21] Appl. No.: 506,249

[22] Filed: Apr. 9, 1990

[51] Int. Cl.[5] ..... H01R 4/24

[52] U.S. Cl. ..... 439/439; 439/441; 439/456

[58] Field of Search ..... 439/438, 439, 440, 441, 439/861, 862, 620, 456, 457, 458

[56] References Cited

U.S. PATENT DOCUMENTS

| | | | |
|---|---|---|---|
| 3,646,582 | 2/1972 | Van Alphen et al. | 439/441 |
| 4,214,135 | 7/1980 | Munroe | 439/456 |
| 5,015,201 | 5/1991 | Brezee et al. | 439/441 |

FOREIGN PATENT DOCUMENTS

| | | | |
|---|---|---|---|
| 1240573 | 5/1967 | Fed. Rep. of Germany | 439/441 |
| 3743409 | 6/1989 | Fed. Rep. of Germany | 439/438 |

*Primary Examiner*—David L. Pirlot
*Attorney, Agent, or Firm*—James W. Miller

[57] ABSTRACT

An improved solenoid comprises a housing having a compartment in which at least two electrical connectors are contained. Each connector comprises a spring clip which resiliently grips the bare wire end of a conductor that is inserted into the connectors. After the conductors are so joined, a separable strain relief cap may be inserted over the solenoid to bend the conductors into a non-linear configuration, resisting accidental displacement. A third connector is preferably electrically joined to one of the first two connectors, to allow the common line to be conveniently extended from one solenoid to the next in a series of such solenoids. In addition, a waterproof grease or gel is injected into the compartments around the connectors.

19 Claims, 2 Drawing Sheets

SOLENOID

TECHNICAL FIELD

This invention relates to an electrical solenoid and, more particularly, to a solenoid having improved electrical connectors for quickly and easily wiring the solenoid into an electrical circuit.

BACKGROUND OF THE INVENTION

Solenoid operated irrigation valves are well known. The valve itself may have any suitable design and typically contains a valve element, such as a resilient diaphragm, that seals against a valve seat. Water is prevented from flowing between the inlet and outlet of the valve whenever the valve element engages the seat. When the valve element is lifted off the seat, water flow through the valve occurs, allowing any sprinklers connected to the valve to operate.

An electrical solenoid is often used to control the opening and the closing of the valve element. In some cases, the armature or plunger of the solenoid is mechanically connected to the valve element to directly lift the valve element off the seat whenever the solenoid is actuated. However, the solenoid is more typically used in a pilot valve fashion to bleed off fluid pressure from one side of the valve element when the solenoid is actuated. This decrease in fluid pressure allows the valve element to lift off its seat. U.S. Pat. Nos. 4,105,186 to Eby and 4,505,450 to Saarem et al show valves of the latter type where the solenoid is used as a pilot valve.

In either case, each solenoid operated valve in an irrigation system is connected to an irrigation controller that actuates the solenoids at predetermined times for predetermined intervals, thus allowing the sprinklers to operate in accordance with whatever program is active in the controller. A controller line, i.e. the "hot wire", extends between the controller and each solenoid for selectively carrying electrical power to that particular solenoid to actuate it. A common line, i.e. the "ground wire", is also connected to each solenoid for completing the electrical circuit to the solenoid. While an individual common line could be run between each solenoid and ground, typically only one solenoid will be grounded with that common line merely being extended from one solenoid to the next, thus decreasing the amount of wiring needed to form the common line.

Those solenoids previously used in irrigation valves have been manufactured and shipped to the field with "pig tails", i.e. two short lengths of wire protruding from the solenoid and connected internally to the solenoid's electrical structure. It is necessary to splice the pig tails into the controller and common lines when the valve is installed in an irrigation system. This is usually done by first stripping the ends of the pig tails and the controller and common lines and by then joining the appropriate lines together using electrical tape, wire nuts or the like. If the common line is extended from this solenoid, then the extension wire also has to be spliced into the common line, usually at the wire nut connection between the common line and the appropriate pig tail.

While the above noted solenoid structure and method of making electrical connections is effective, it has a number of disadvantages. First, the installer has to strip and overlay the appropriate wires and then secure them together with a wire nut or similar device. This can be time-consuming and laborious especially when working in the enclosed space of a valve box in which the valve is normally contained. Moreover, it is somewhat costly to manufacture a solenoid having "pig tails" and it is necessary to protect the pig tails from damage during shipping. Finally, solenoid operated irrigation valves are by their very nature located in outdoor environments where moisture is present. While some protection is afforded by enclosing the valve inside a valve box, nonetheless moisture will find its way into the valve box. The wire nut connections typically used are subject to degradation and/or shorting from this moisture.

SUMMARY OF THE INVENTION

Accordingly, one aspect of this invention is to provide an improved solenoid for use with fluid operated valves, such as irrigation valves, which may be quickly and easily connected to the controller and common lines and which is resistant to moisture contamination.

A solenoid according to this invention comprises a housing having a compartment enclosed by a circumferential side wall. Access means extend through the housing side wall and communicate with the compartment for allowing at least two electrical conductors to be pushed into the compartment. Each of the conductors has a bare wire end received in the compartment. In addition, at least two electrical connectors are carried in the compartment. Each connector comprises a base leg and a resilient leg biased towards the base leg to define an entrance therebetween. The resilient leg is deflectable away from the base leg as an electrical conductor is pushed inwardly into the entrance of the connector to capture the wire end of the conductor between the base leg and the resilient leg. The access means and connector entrances are aligned with one another to allow the conductors to be pushed in a straight line through the openings and into the connectors to couple the conductors to the connectors, whereby electrical connection of the conductors to the solenoid may be achieved simply by pushing the bare wire ends of the conductors through the access openings and into the compartment.

BRIEF DESCRIPTION OF THE DRAWINGS

The present invention will be described in more detail hereafter in the Detailed Description, when taken in conjunction with the following drawings, in which like reference numerals refer to like elements throughout.

DETAILED DESCRIPTION

Figure 1:
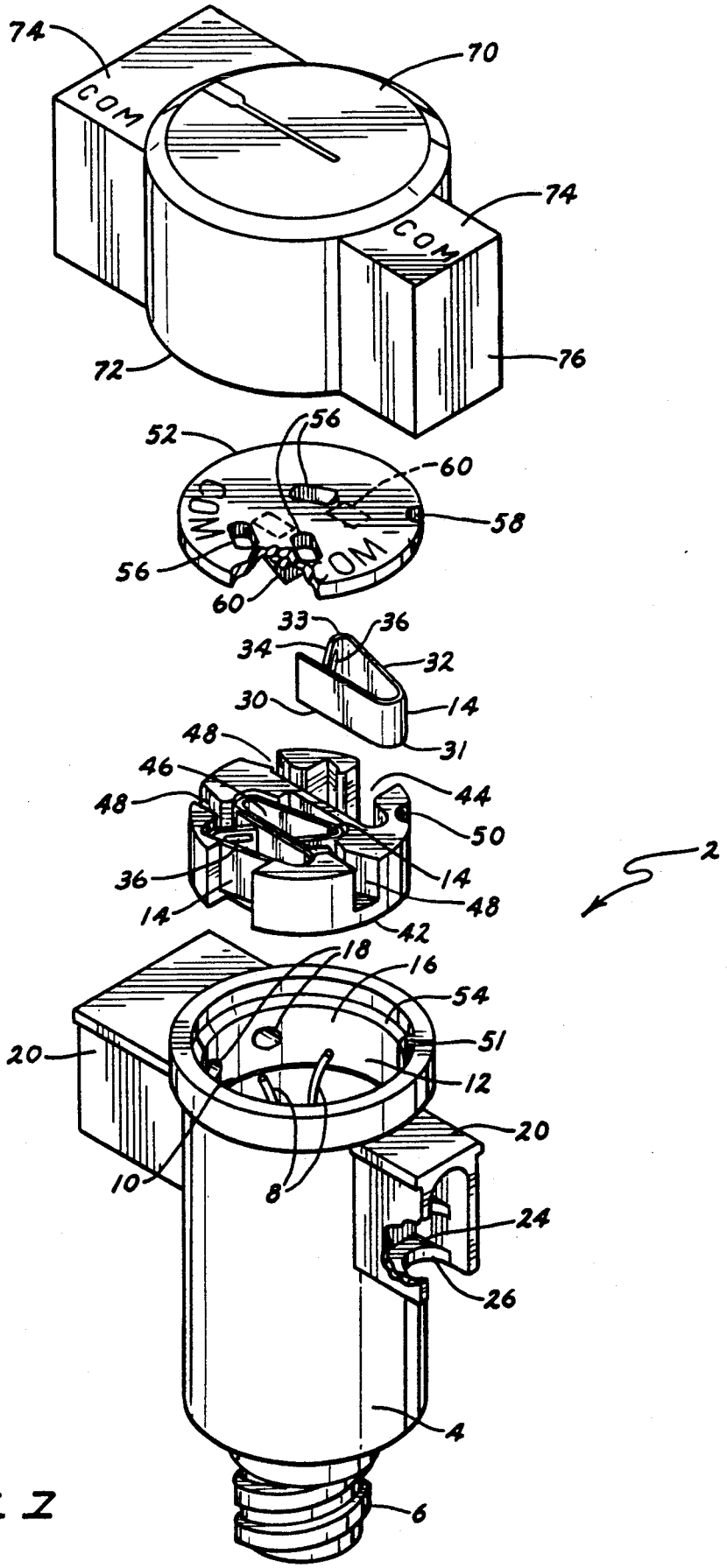
FIG. 1 is a perspective view of an improved solenoid according to this invention, shown in an exploded form with the components thereof being separated for clarity.

Referring first to FIG. 1, an improved solenoid according to the present invention is generally illustrated as 2. Solenoid 2 may be attached to a fluid flow control valve (not shown), of any conventional design, such as the pressure balanced, diaphragm valve shown in U.S. Pat. No. 4,505,450 to Saarem et al, which patent is incorporated by reference. In this valve, the solenoid is coupled to the valve body with its plunger in contact with and sealing a bleed assembly. When the solenoid is actuated, the plunger lifts off the valve seat, opening the bleed assembly to relieve fluid pressure from one side of the diaphragm, allowing the valve to open. However, solenoid 2 is not limited for use solely with valves or with this specific type of valve.

Solenoid 2 includes a generally cylindrical housing 4 having a threaded lower end 6 which screws into a threaded bore in the valve body for securing solenoid 2 to the valve. An electrical coil (not shown) surrounds a movable armature or plunger (not shown) inside solenoid housing 4. Electrical leads 8 are connected to this coil and extend upwardly. When the coil is energized by applying electrical power to leads 8, a magnetic field is created which moves the solenoid plunger longitudinally relative to housing 4. The coil and armature structures of solenoid 2 are not important to the present invention; any known configuration may be used.

Solenoid 2 includes a compartment 12 at its upper end which houses a plurality of improved electrical connectors 14. The lower end of compartment 12 is defined by an annular rim or shoulder 10 with electrical leads 8 extending upwardly past rim 10 into compartment 12. In addition, compartment 12 includes a circumferential side wall 16 formed by the cylindrical shape of housing 4. At least two, and preferably three, access openings 18 extend through side wall 16 into compartment 12. Two access openings 18 are grouped together on one side of housing 4 while the other opening 18 is placed on the opposite side of housing 4.

Rectangular projections 20 extend outwardly from each side of housing 4 and enclose access openings 18. Each projection 20 comprises an open-ended downwardly facing rectangular box integrally molded to housing 4. Each access opening 18 comprises an elongated horizontal bore which tapers inwardly at 22 as it proceeds towards compartment 12. The inward taper at 22 performs a wire guiding function as described later.

Figure 3:
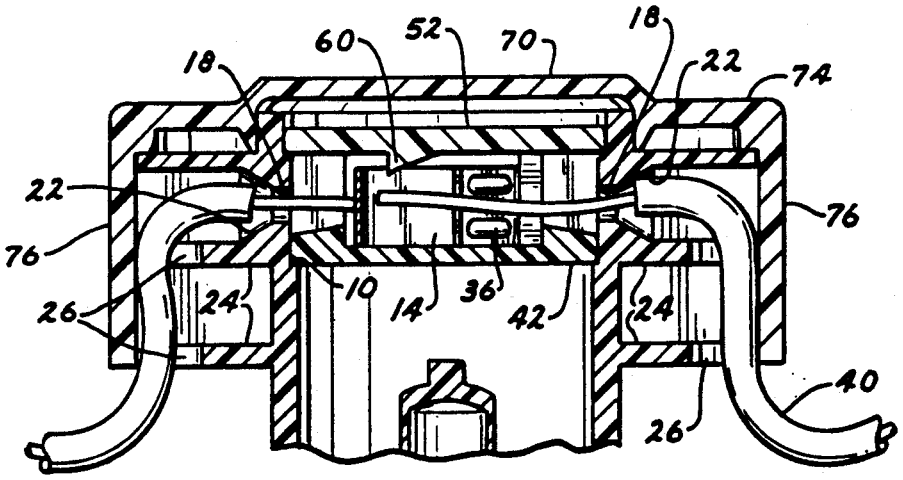
FIG. 3 is a cross-sectional side elevational view of the top portion of the solenoid taken along lines 3—3 in FIG. 2, particularly illustrating the components in an assembled relationship with the cap having been attached to the housing for deflecting the electrical conductors into a non-linear orientation.

In addition, each projection 20 includes two horizontal, outwardly extending tabs 24 beneath access opening 18. Tabs 24 are parallel and vertically spaced from one another as shown in FIG. 3. Each tab 24 is curved at its outer end to form a semi-circular recess 26 spaced away from housing 4 by the length of tab 24. Tabs 24 form, in effect, a vertically extending wire receiving groove or channel, for the purpose described hereafter.

A single box-like projection 20 could be used to house each access opening 18 and the two curved tabs 24 located beneath opening 18. However, since two access openings 18 are already grouped together as shown on the left side of FIG. 1, a single wide projection 20 encloses both access openings 18.

Figure 2:
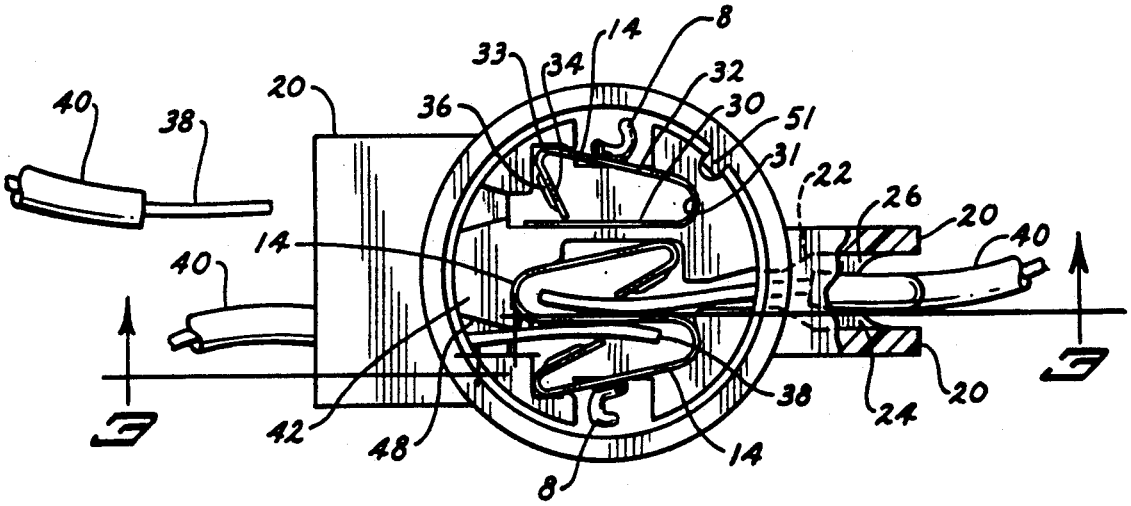
FIG. 2 is a top plan view of the solenoid shown in FIG. 1 with the cover and the cap having been removed for clarity, the figure particularly illustrating the electrical connection between the electrical conductors and the electrical connectors of the solenoid.

As noted earlier, a plurality of electrical connectors 14 are located in compartment 12, preferably three such connectors 14 corresponding to the number of access openings 18. Each connector 14 is basically a spring clip which resiliently grips a wire end when that end is pushed inwardly into the connector. Referring to FIGS. 1 and 2, each connector 14 is generally U-shaped having a straight base leg 30, a small radius curved portion 31 leading to a second intermediate leg 32, and an additional small radius curved portion 33 connecting a deflectable leg 34 to the end of intermediate leg 32. Connectors 14 are integrally formed from any suitable metallic material by cutting the material to a proper width and length and by then bending the material into the shape noted above.

Deflectable leg 34 is bent back rearwardly relative to the intermediate and base legs and is either in contact with or slightly spaced from base leg 30 in a normal undeflected configuration of connector 14. When the bare wire end 38 of an electrical conductor 40 is pushed inwardly into connector 14, i.e. into the entrance between deflectable leg 34 and base leg 30, it will engage and deflect leg 34 away from base leg 30 until wire end 38 is resiliently captured or pinched between legs 30 and 34. See FIG. 2. Deflectable leg 34 is provided on its front face with two spaced ribs 36, one of which is shown in FIGS. 1 and 2. Ribs 36 help guide wire end 38 into connector 14 and also stiffen leg 34 and prevent it from being crushed by the insertion of conductor 40. Connectors 14 as described herein are sometimes known as "pressure lock" connectors.

Connectors 14 could be supported in compartment 12 in various ways. However, a generally cylindrical holder 42, made of any suitable dielectric material (e.g. plastic), is preferably used to carry connectors 14. Holder 42 has a first cavity 44 which holds a first connector 14. In addition, holder 42 has a second cavity 46 which holds the other two connectors 14. When connectors 14 are in place in their respective cavities, holder 42 may be dropped down into compartment 12 and retained therein by annular rim 10 at the bottom of compartment 12. Holder 42 conveniently and securely carries connectors 14.

Connectors 14 in cavity 46 are placed back-to-back and are electrically joined together by abutting and welding their base legs 30 together. These connectors 14 are also oppositely disposed relative to one another to point to opposite sides of solenoid 2. This electrically joined pair of connectors 14 is fixed to one electrical lead 8 of solenoid 2 while the other single connector 14 is fixed to the other lead 8. Connectors 14 are press fit down into their respective cavities 44 and 46 in holder 42 after the leads are attached.

Holder 42 includes three slots or wire guide channels 48 adjacent the periphery of holder 42 leading inwardly to connectors 14. The walls which define channels 48 are tapered inwardly relative to one another to further help align conductor 40 with connector 14 when conductor 40 is pushed inwardly. See FIG. 2. Each channel 48 is aligned with one of the access openings 18. A keyway 50 provided on holder 42 engages a spline 51 on side wall 16 to ensure this alignment when holder 42 is inserted into compartment 12.

After holder 42 is put in place in compartment 12, a circular cover 52 is dropped down into compartment 12 until it contacts an inwardly protruding shoulder 54 at the upper end of compartment 12. Cover 52 is fixed in place by any suitable means, e.g. by heat staking. Cover 52 provides a closed top wall for compartment 12. Preferably, cover 52 is made from a transparent plastic material, such as Lexan, to allow the electrical connections between conductors 40 and connectors 14 to be viewed.

Cover 52 has three rectangular holes 56 each of which is located above the deflectable leg 34 of an underlying connector 14. Holes 56 allow the user to release conductors 40 from connectors 14 by inserting a pointed tool of some type through hole 56 and using that tool to move leg 34 to release pressure from conductor 40 to allow conductor 40 to be pulled out. Cover 52 has a keyway 58, similar to keyway 50 on holder 42, for aligning cover 52 in compartment 12.

In addition, cover 52 includes three inclined ramps 60 on its lower surface. Each ramp 60 is positioned to fit down into the interior of each connector 14 between base leg 30 and intermediate leg 32 and faces towards the deflectable leg 34. Each ramp 60 helps guide a wire end 38 into place when conductor 40 is pushed into connector 14 by engaging wire end 38 to push it back down into connector 40 should the wire end tend to rise up out of connector 14. In addition, the presence of cover 52 itself helps retain wire ends 38 in connectors 14. For example, if conductors 40 were pivoted downwardly tending to rotate the ends 38 up out of connectors 14, the ends 38 would engage cover 52 and be prevented from disengaging connectors 14.

Solenoid 2 as described thus far is easily used in the field. For example, if solenoid 2 is part of an irrigation valve, the installer no longer has to splice pig tail connections or use wire nuts. All he need do is to take the hot and common conductor lines, strip these lines if they have not already been stripped to expose a bare wire end, and then push the conductors 40 inwardly through access openings 18 in the wider projection 20. The common line conductor 40 is pushed into the opening labeled COM and the hot wire conductor 40 is pushed into the other opening. The COM labeling is present both on cover 52 and a cap 70 described hereafter.

As the wire ends 38 are pushed inwardly, they are easily guided into place in connectors 14. First, the wire engages the tapered walls 22 of access opening 18, then the tapered wire guide channels 48 in holder 42, then the spaced ribs 36 on the face of deflectable leg 34, and finally, if need be, the tapered ramps 60 on the lower surface of cover 52. All of these, both individually and collectively, help ensure that conductors 40, when pushed into access openings 18 from the side in a straight manner, become properly seated in connectors 14.

The use of a third connector 14 in holder 42, i.e. the connector in the narrower projection 20, electrically joined to one of the other connectors 14 is also advantageous. This third connector forms a convenient way of extending the common line out to adjacent solenoids such as those on adjacent valves in an irrigation system. Assuming one solenoid in a series has been directly wired as described above to the common and hot lines leading from the irrigation controller, it is not necessary to use a separate common line leading from the controller to all the other solenoids. Instead, the installer simply pushes a conductor 40 into the third connector 14 of the first solenoid 2 and then directs that conductor to the next solenoid 2 where it is attached as the incoming common line, a shorter distance in most cases than going all the way back to the controller. This is continued from each valve to the next in the entire series.

Solenoid 2 of this invention has numerous advantages. It's easy to wire into an electrical circuit in the field and does not use splice or wire nut connections. Thus, conductors 14 can an be quickly and easily connected or disconnected from the solenoid whenever the solenoid is installed or replaced. Moreover, a solenoid 2 having three connectors 14, with two of the connectors being joined into a common pair, allows the common line to be conveniently extended therefrom.

Electrical connectors 14 are wholly enclosed inside compartment 12 and are thus protected from moisture in the environment in which solenoid 2 is used. To further help assure reliability, a silicone based, waterproof, dielectric grease or gel is preferably injected into compartment 12 around connectors 14. Moreover, the use of a transparent cover 52 is advantageous as it allows the user of the solenoid to see whether or not the electrical connections are being properly made as he pushes conductors 40 inwardly into compartment 12. This provides a "comfort level" for many potential users of solenoid 2, such as irrigation contractors, which encourages wider use of solenoid 2. In this regard, the grease or gel used in compartment 12 around connectors 14 is also preferably transparent so as to not obscure the connections.

Solenoid 2 as described to this point represents a useful improvement over prior art solenoids. However, it is preferred that a separable strain relief cap, shown generally at 70, be used to enclose the top end of solenoid 2. Cap 70 includes a cylindrical body 72 with two outwardly extending wings 72 shaped to fit around the top of solenoid housing 2, including projections 20, in a press fit. When so installed, wings 72 closely engage around projections 20 with the side walls 76 of wings 74 closing off the face of projections 20. See FIG. 3 in which cap 70 is shown in place over solenoid 2.

Cap 70 is installed after the user has wired the solenoid to the hot and common conductors 40. Remember, that the user inserts these conductors into connectors 14 by pushing the conductors in a straight line inwardly through the access openings and into the compartment 12. After conductors 40 are connected in this fashion, they extend out from solenoid generally in a straight line. These conductors can then sometimes be disengaged from connectors 14, i.e. be pulled out of solenoid 14, if any external pulling force is exerted on the conductors. This force can accidentally or inadvertently occur due to a variety of circumstances.

However, look what happens when cap 70 is pressed down onto solenoid 2 after the connections are made. The lower edge of cap 70 engages the outwardly extending conductors 40 and bends them downwardly until the conductors are bent approximately 90° and extend vertically downwardly in the semi-circular recesses 26 in tabs 24. In this non-linear orientation for conductors 40, a strain relief is provided which helps keep the conductors in place even if an outside pull is exerted on the conductors. Cap 70 may be easily pulled off solenoid 2 whenever necessary either to remove conductors 40 for connectors 14 or to look down through cover 52 for inspecting the electrical connections.

Cap 70 also helps further seal and enclose compartment 12, overlying cover 52 to close holes 56, to further help prevent moisture contamination of the electrical connections. In this regard, one should remember that the irrigation valve and solenoid 2 mounted on such valve are typically enclosed in a valve box which can have standing water in it. If such water were to rise up around cap 70, cap 70 forms an air gap or pocket for preventing water from entering compartment 12, i.e. water will rise around cap 70 but will not enter into the space between cap 70 and housing 4. Thus, the use of a separable cap which creates such an air pocket further insures that solenoid 2 will continue to operate reliably.

Various modifications of this invention will be apparent to those skilled in the art.

I claim:

1. An improved solenoid, which comprises:

(a) a housing having a compartment at one end thereof, the housing having access means communicating with the compartment for allowing at least two electrical conductors to be pushed into the compartment, each of the conductors having a bare wire end suited to be received in the compartment when the conductors are pushed into the compartment;

(b) at least two electrical connectors carried in the compartment, wherein each connector comprises a base leg and a resilient leg biased towards the base leg to define an entrance therebetween, wherein the resilient leg is deflectable away from the base leg as an electrical conductor is pushed inwardly into the entrance to capture the wire end of the conductor between the base leg and the resilient leg, and wherein the access means and connector entrances are generally aligned with one another to allow the conductors to be pushed in a straight line through the access means and into the connectors to couple the conductors the the connectors, whereby electrical connection of the conductors to the solenoid may be achieved simply by pushing the bare wire ends of the conductors through the access means and into the compartment;

(c) strain relief means for engaging the conductors and deflecting them into a non-linear orientation after the conductors are coupled tot he connectors, whereby outward pulling force on the wire ends of the conductors is relieved to help keep the conductors in place, wherein the strain relief means comprises a cap having a shape that sufficiently matches that of the one end of the housing to allow the cap to be pushed down over the one end of the housing to separably attach the cap to the housing, the cap having a portion which engages the conductors and bends the conductors downwardly into the non-linear orientation when the cap is fully received on the one end of the housing; and (d) at least two donwardly extending, semi-circular vertical grooves on an exterior surface of the housing beneath the access means, each groove shaped to receive one of the conductors therein when the conductors are deflected downwardly by the cap.

2. An improved solenoid as recited in claim 1, further including a substantially waterproof, dielectric grease in the compartment surrounding at least the connectors.

3. An improved solenoid as recited in claim 1, wherein the housing includes a circumferential side wall which encloses the compartment, and wherein the access means is located in the side wall.

4. An improved solenoid as recited in claim 3, wherein the one end of the housing is cylindrical except for an outwardly extending projection which houses the access means and terminates in a generally planar face spaced outwardly from the housing side wall, wherein each semi-circular vertical recess is located adjacent the face of the projection, and wherein the cap includes a cylindrical body and an outwardly projecting wing which wing is shaped to be received around the projection, the wing having a side wall closely proximate to the face of the projection when the cap is received on the one end of the housing so that the conductor will be received in the semi-circular recess after the cap has bent the conductors downwardly.

5. An improved solenoid as recited in claim 1, wherein the compartment includes a top wall relatively closely overlying the connectors to prevent the conductors from pivoting upwardly out of the connectors when the conductors are deflected downwardly by the separable cap.

6. An improved solenoid as recited in claim 5, wherein the top wall includes an aperture overlying the resilient leg of each connector, wherein each aperture is sized to allow a pointed tool to be inserted through the aperture and deflect the resilient leg away from the base leg to allow the conductor to be released from the connector, the top wall of the compartment normally being hidden by the separable cap but being accessible whenever the cap is removed from the housing.

7. An improved solenoid as recited in claim 6, wherein the top wall is transparent to allow the user to inspect the connections between the conductors and the connectors when the cap is removed.

8. An improved solenoid, which comprises:

(a) a housing having a compartment enclosed by a circumferential side wall, the housing having access means in the side wall communicating with the compartment for allowing at least two electrical conductors to be pushed into the compartment, each of the conductors having a bare wire end suited to be received in the compartment when the conductors are pushed into the compartment;

(b) at least two electrical connectors carried in the compartment, wherein each connector comprises a base leg and a resilient leg biased towards the base leg to define an entrance therebetween, wherein the resilient leg is deflectable away from the base leg as an electrical conductor is pushed inwardly into the entrance to capture the wire end of the conductor between the base leg and the resilient leg, and wherein the access means and connector entrances are generally aligned with one another to allow the conductors to be pushed in a straight line through the access means and into the connectors to couple the conductors to the connectors, whereby electrical connection of the conductors to the solenoid may be achieved simply by pushing the bare wire ends of the conductors through the access means and into the compartment; and (c) wherein the compartment is adjacent one end of the housing and is open from one side thereof to be accessible through the one end of the housing, wherein the electrical contacts are carried in a holder with the holder having wire guide channels extending between an exterior surface of the holder and the connector entrances, and wherein the holder is shaped to be press fit into the compartment with the wire guide channels in the holder aligned with the access means in the side wall of the housing.

9. An improved solenoid as recited in claim 8, wherein the access means comprises at least two access openings, wherein both the access openings and the wire guide channels have converging walls as the conductors pass radially inwardly through the openings and the wire guide channels to help center the conductors in the entrances of the connectors as they are pushed into the compartment.

10. An improved solenoid as recited in claim 8, wherein the connectors are press fit into the holder.

11. An improved solenoid as recited in claim 8, wherein the holder is made of a dielectric material.

12. An improved solenoid as recited in claim 8, further including a cover closing off the open end of the compartment and overlying the connectors, the cover having wire guide means formed on a bottom surface thereof and projecting downwardly above the entrance channels to the connectors to further aid in centering the wires in the channels.

13. An improved solenoid as recited in claim 12, wherein the wire guide means comprises an inclined ramp on the cover aligned with each connector.

14. An improved solenoid as recited in claim 12, wherein both the holder and the cover are keyed to the compartment so that the holder and cover will be properly aligned in the compartment as they are press fit into the compartment.

15. An improved solenoid, which comprises:

(a) a housing having a compartment enclosed by a circumferential side wall, the housing having two access openings in the side wall communicating with the compartment for allowing at least two electrical conductors to be pushed into the compartment, each of the conductors having a bare wire end suited to be received in the compartment when the conductors are pushed into the compartment;

(b) at least two electrical connectors carried in the compartment, wherein each connector comprises a base leg and a resilient leg biased towards the base leg to define an entrance therebetween, wherein the resilient leg is deflectable away from the base leg as an electrical conductor is pushed inwardly into the entrance to capture the wire end of the conductor between the base leg and the resilient leg, and wherein the access means and connector entrances are generally aligned with one another to allow the conductors to be pushed in a straight line through the access means and into the connectors to couple the conductors to the connectors, whereby electrical connection of the conductors to the solenoid may be achieved simply by pushing the bare wire ends of the conductors through the access means and into the compartment;

(c) a third access opening in the side wall of the housing and a third electrical connector contained in the compartment, wherein the third electrical connector is substantially identical to the first two electrical connectors and is electrically connected to one of the first two electrical connectors to form in combination therewith an electrically joined pair of connectors, whereby a common line when inserted into one of the connectors of the joined pair may be extended from the solenoid by a third electrical conductor coupled to the other connector of the joined pair; and (d) wherein each of the connectors is generally U-shaped with the base leg comprising one leg of the U, and wherein the connectors in the joined pair are placed back-to-back with the base legs thereof abutting and with the entrances of the connectors facing to opposite sides of the compartment, and wherein the base legs of the connectors in the joined pair are fixed to one another in electrical contact with each other.

16. An improved solenoid as recited in claim 15, further including indicia means for designating the connectors in the joined pair as common line connectors.

17. An improved solenoid as recited in claim 15, wherein the base legs of the connectors in the joined pair are welded together.

18. An improved solenoid as recited in claim 15, wherein the compartment is adjacent one end of the housing and is open from one side thereof to be accessible through the one end of the housing, wherein the electrical contacts are press fit into a holder made of a dielectric material with the holder shaving wire guide channels extending between an exterior surface of the holder and the entrances of the connectors, and wherein the holder is shaped to be press fit into the compartment with the wire guide channels in the holder aligned with the access means in the side wall of the housing.

19. An improved solenoid for connection in an electrical circuit having a hot line and a common line, comprising:

(a) a housing having a compartment enclosed by a circumferential side wall, the housing having three access openings extending through the housing side wall and communicating with the compartment for allowing up to three electrical conductors to be pushed into the compartment, each of the conductors having a bare wire end received in the compartment;

(b) three electrical connectors carried in the compartment, wherein each connector comprises means for resiliently gripping the bare wire end of the conductor when the conductor is pushed into an entrance of the connector, wherein the access openings and entrances of the conductors are aligned with one another to allow the conductors to be pushed through the openings and into the connector entrances to couple the conductors to the connectors, whereby electrical connection of the conductors to the solenoid may be achieved simply by pushing the bare wire ends of the conductors through the access openings and into the compartment;

(c) wherein two of the connectors are electrically connected together to form an electrically joined pair of connectors, whereby a common line when inserted into one of the connectors of the joined pair may be extended from the solenoid by an electrical conductor coupled to the other connector of the joined pair; and (d) wherein each of the connectors comprises a generally U-shaped spring slip, wherein the connectors in the joined pair are placed back-to-back in an abutting relationship with the entrance channels of the connectors facing to opposite sides of the compartment, and wherein the abutting portions of the connectors in the joined pair are fixed to one another in electrical contact with each other.

* * * * *